US007352336B1

(12) United States Patent
Lier et al.

(10) Patent No.: US 7,352,336 B1
(45) Date of Patent: Apr. 1, 2008

(54) DIRECTIVE LINEARLY POLARIZED MONOPOLE ANTENNA

(75) Inventors: Erik Lier, Newtown, PA (US); Bernard F Lindinger, Elkins Park, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/652,608

(22) Filed: Jan. 12, 2007

(51) Int. Cl.
*H01Q 9/28* (2006.01)
*H01Q 19/30* (2006.01)
*H01Q 9/38* (2006.01)

(52) U.S. Cl. ..... 343/795; 343/819; 343/830

(58) Field of Classification Search ..... 343/795, 343/819, 818, 829, 830
See application file for complete search history.

(56) References Cited

U.S. PATENT DOCUMENTS 6,307,524 B1 * 10/2001 Britain ..... 343/795
6,326,922 B1 * 12/2001 Hegendoerfer ..... 343/700 MS
2007/0001924 A1 * 1/2007 Hirabayashi ..... 343/893

* cited by examiner

*Primary Examiner*—Shih-Chao Chen
(74) *Attorney, Agent, or Firm*—McDermott Will & Emery LLP

(57) ABSTRACT

A directive monopole antenna element with good RF performance (e.g., directivity and cross-polarization) and a low assembly cost is provided. The directive monopole antenna includes a dielectric support structure and one or more conductive directors coupled to the support structure. Each of the conductive directors is disposed parallel to every other conductive director and in a first plane of the support structure. The directive monopole antenna further includes a conductor coupled to an end of the support structure. The conductor has a feed probe section disposed in the first plane perpendicular to the one or more conductive directors and extending beyond the end of the support structure. The conductor further has a bent section disposed in the first plane parallel to the one or more conductive directors. The feed probe section and the bent section are electrically coupled. The directive monopole antenna element may be fed by a waveguide or a coaxial feed line.

22 Claims, 9 Drawing Sheets

DIRECTIVE LINEARLY POLARIZED MONOPOLE ANTENNA

CROSS-REFERENCE TO RELATED APPLICATION

Not applicable.

STATEMENT REGARDING FEDERALLY SPONSORED RESEARCH OR DEVELOPMENT

Not applicable.

FIELD OF THE INVENTION

The present invention generally relates to monopole antennas and, in particular, relates to directive linearly polarized monopole antennas for use in phased arrays.

BACKGROUND OF THE INVENTION

In many antenna arrays, it is desirable to use antenna elements that are both highly directive and simple to assemble. One type of endfire antenna element used in various antenna arrays is a "Yagi" element. While Yagi elements exhibit good directivity, the cost and complexity of their assembly (e.g., one half of the driver dipole must be connected to ground, increasing the over-life risk and number of manufacturing steps) leave much to be desired. Another endfire antenna element used in various antenna arrays is a "zigzag" element. A zigzag element can be probe-fed into the waveguide of an array with low assembly cost (e.g., not requiring a connection to ground), but the RF performance of this kind of element is unsuitable for many applications (e.g., having poor cross-polarization and directivity/bandwidth).

SUMMARY OF THE INVENTION

The present invention solves the foregoing problems by providing a directive monopole antenna element with good RF performance (e.g., directivity and cross-polarization) and low assembly cost and complexity.

According to one embodiment of the present invention, a directive monopole antenna comprises a dielectric support structure and a conductor coupled to an end of the support structure. The conductor has a feed probe section disposed in a first plane of the support structure and extending beyond the end of the support structure. The conductor further has a bent section disposed in the first plane perpendicular to the feed probe section. The feed probe section and the bent section are electrically coupled. The directive monopole antenna further comprises one or more conductive directors coupled to the support structure, each of the one or more conductive directors being disposed in the first plane of the support structure and parallel to the bent section of the conductor According to another embodiment of the present invention, an antenna array comprises a plurality of bent directive monopole antenna elements, each of which includes a dielectric support structure and one or more conductive directors coupled to the support structure. Each of the one or more conductive directors is disposed parallel to every other one of the one or more conductive directors and in a first plane of the support structure. Each of the plurality of bent directive monopole antenna elements further includes a conductor coupled to an end of the support structure. The conductor has a feed probe section disposed in the first plane perpendicular to the one or more conductive directors. The conductor further has a bent section disposed in the first plane parallel to the one or more conductive directors. The feed probe section and the bent section are electrically coupled. The antenna array further comprises a ground plane with a plurality of openings corresponding to the plurality of bent directive monopole antenna elements. Each of the plurality of bent directive monopole antenna elements is disposed in one of the plurality of openings in the ground plane. The antenna array further comprises a plurality of waveguides corresponding to the plurality of bent directive monopole antenna elements. Each of the plurality of bent directive monopole antenna elements is fed by a corresponding waveguide. The antenna array further comprises one or more amplifiers operatively coupled to the plurality of bent directive monopole antenna elements.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

According to various embodiments of the present invention, a highly directive endfire antenna with excellent RF characteristics (e.g., cross-polarization) can be inexpensively manufactured and easily mounted in a ground plane, or in an antenna array with a shared ground plane, without experiencing any of the drawbacks of the Yagi (e.g., over-life risk, manufacturing complexity, etc.) or the zigzag (e.g., poor RF performance) antenna element designs.

Figure 1A:
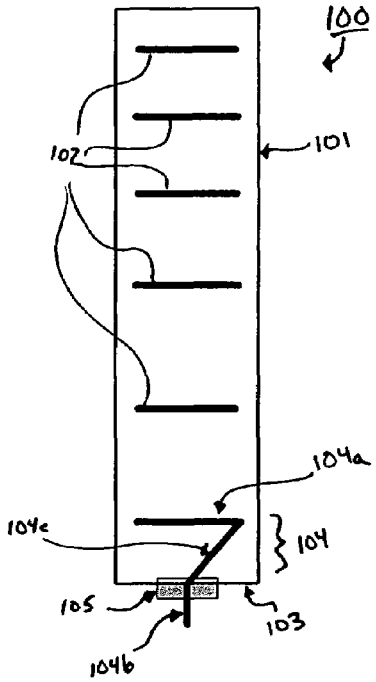
FIGS. 1A to 1D illustrate directive monopole antennas according to various embodiments of the present invention.

In FIG. 1A, a highly directive bent monopole antenna 100 is illustrated according to one embodiment of the present invention. Directive monopole antenna 100 includes support structure 101, which in this exemplary embodiment is composed of a low-loss dielectric material such as an Ultem® resin. Lying in a plane of support structure 101 and coupled thereto are a number of parallel conductive directors 102. In the present exemplary embodiment, directors 102 are composed of a conductive material, such as copper. Coupled to one end 103 of support structure 101 is a conductor 104, which includes a bent section 104*a* parallel to directors 102, and a feed section 104*b* extending from end 103 and perpendicular to directors 102. Bent section 104*a* and feed probe section 104*b* are electrically coupled by intermediate section 104*c*. In the present exemplary embodiment, conductor 104 is formed by bending a single length of conductive material, such as copper, into the illustrated shape. In alternative embodiments, a conductor such as conductor 104 may be formed by bonding multiple discrete pieces of conductive material, and may comprise numerous different conductive materials. Directive monopole antenna 100 further includes a dielectric plug 105, which is disposed at end 103 of support structure 101, surrounding feed probe section 104*b*. Dielectric plug 105 allows directive monopole antenna 100 to be coupled with a ground plane without allowing feed probe section 104*b* to come into electrical contact with the ground plane, as is illustrated in greater detail below.

Figure 1B:
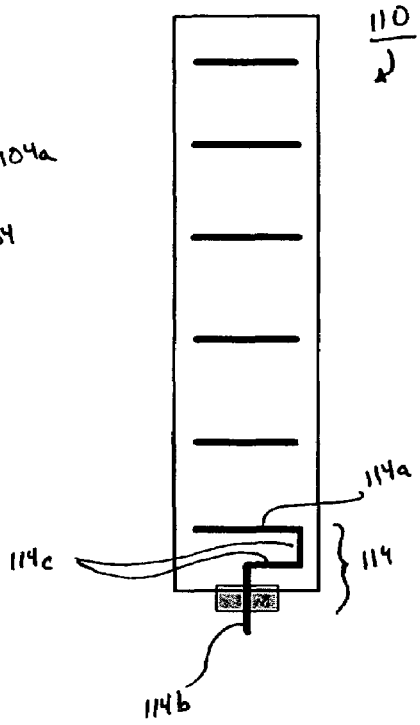

FIG. 1B illustrates another directive monopole antenna 110 according to one embodiment of the present invention. Directive monopole antenna 110 differs from directive monopole antenna 100 illustrated in FIG. 1A in the arrangement of conductor 114. In the present exemplary embodiment, the feed probe section 114*b* and the bent section 114*a* of conductor 114 are electrically coupled by a number of intermediate sections 114*c*.

Figure 1C:
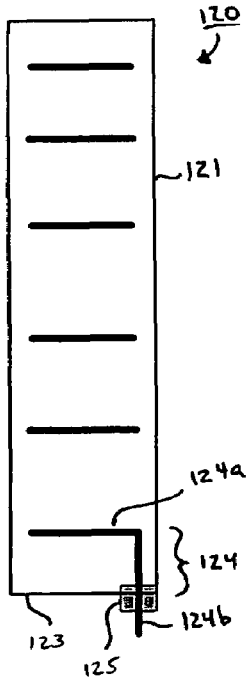

In the foregoing exemplary embodiments, directive monopole antennas 100 and 110 are illustrated as being "center-fed," in that the feed probe sections thereof are disposed approximately in the middle of the ends of the directive monopole antennas. While this arrangement renders the directive monopole antennas relatively insensitive to rotation around the feed probes (with respect to the endfire position of the antennas, but not, obviously, with respect to the polarization thereof), it will be readily apparent to one of skill in the art that the scope of the present invention is not limited to such an arrangement. Indeed, as is illustrated in FIG. 1C, a directive monopole antenna 120 is configured in an "offset-fed" arrangement, in which the feed probe section 124*b* is disposed closer to one side of the end 123 of the support structure 121. In such an arrangement, the dielectric plug 125 is similarly disposed nearer to one side of end 123. As is apparent from FIG. 1C, in such an arrangement, an intermediate section may not be necessary to electrically couple feed probe section 124*b* to the bent section 124*a* of conductor 124.

Figure 1D:
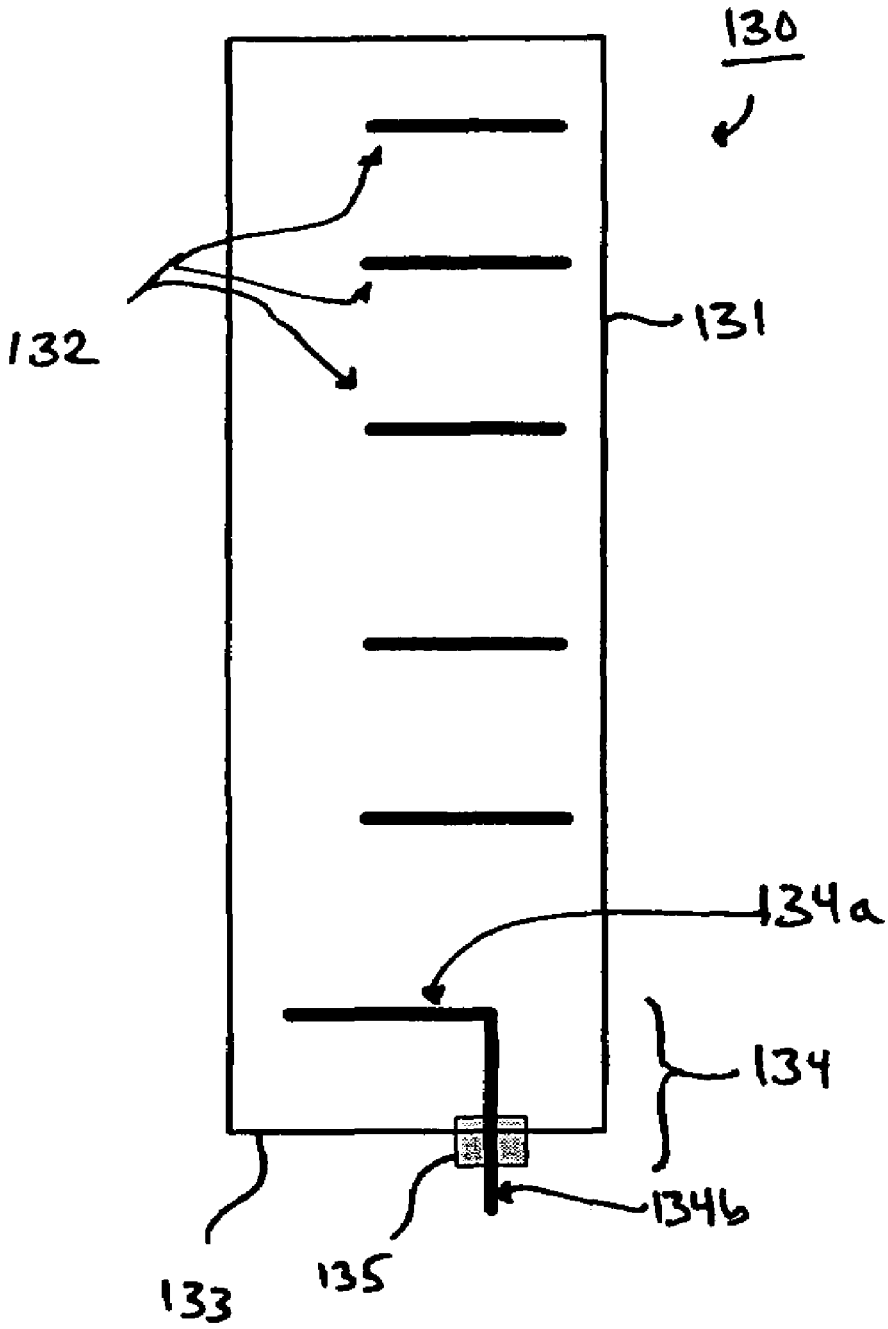

Turning to FIG. 1D, a directive monopole antenna 130 is illustrated in an "electrically center-fed" arrangement, according to one embodiment of the present invention. In this arrangement, the support structure 131 of directive monopole antenna is wider than directors 132, which are offset to one side of support structure 131. Conductor 134 includes a feed probe section 134*b*, surrounded by a dielectric plug 135, near the middle of end 133. The bent section 134*a* of conductor 134 is offset closer to the opposite side of support structure 131 than directors 132. Such a physical configuration can provide an "electric center" of directive monopole antenna 130 directly above feed probe section 134*b*, rendering directive monopole antenna 130 relatively insensitive to rotation about feed probe section 134*b*.

Figure 2:
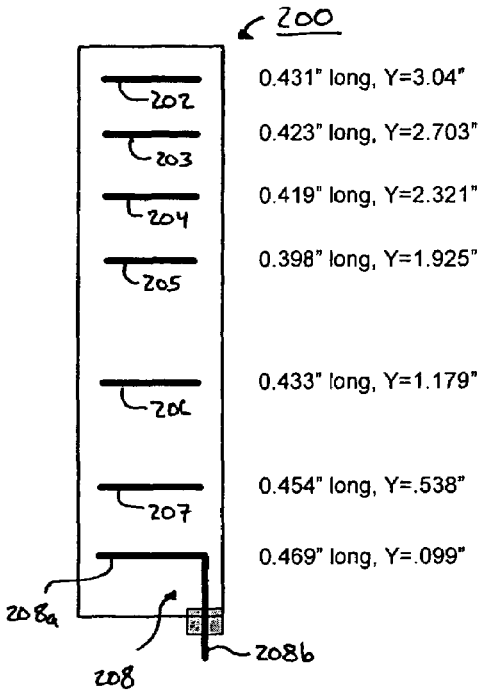
FIG. 2 illustrates a directive monopole antenna according to one embodiment of the present invention.

According to one aspect of the present invention, computer optimization is used to select the dimensions of the conductor and the directors, together with the spacing between them, based upon the desired operating frequencies and performance characteristics of the directive monopole antenna. Turning to FIG. 2, an exemplary experimental embodiment of a directive monopole antenna of the present invention is illustrated, together with the dimensions and arrangement of the components thereof. As can be seen with reference to FIG. 2, directive monopole antenna 200 includes six conductive directors 202-207 with varying dimensions and varying space between them. According to one aspect of the present invention, all of the conductive directors, together with the bent section 208*a* of conductor 208, are about $\lambda/2$ long (i.e., within 20% of $\lambda/2$), where $\lambda$ is an operational frequency of directive monopole antenna 200. For example, in the present exemplary embodiment optimized for use between about 11.7 GHz and 12.2 GHz (where $\lambda/2$ is approximately 0.5"), bent section 208*a* and each one of conductive directors 202-207 are within 20% of 0.5". This is the result of the computer optimization process beginning with a value of $\lambda/2$ for the bent section and each one of the conductive directors of the directive monopole antenna, and then iteratively adjusting the length of each component (a process intimately familiar to those of skill in the art), together with the vertical position of each component (i.e., the spacing between each) until the antenna exhibits, in computer simulation, the desired RF performance characteristics (e.g., directivity greater than 15 dB, cross-polarization better than −35 dB, etc.). The "Y" values indicated in FIG. 2 are a measurement of the distance of each component above a ground plane, a feature included in some embodiments of the present invention, which is illustrated in greater detail with respect to FIG. 3, below.

Figure 3:
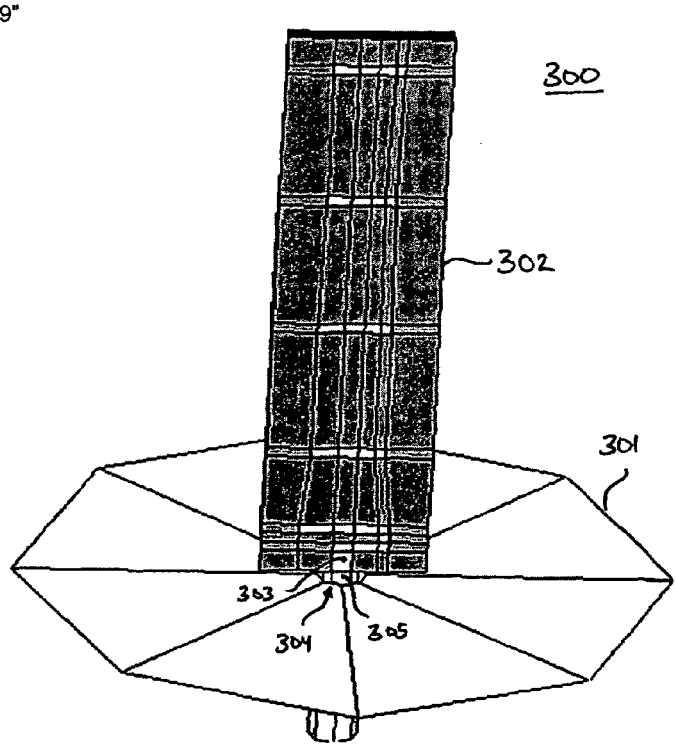
FIG. 3 illustrates a directive monopole antenna according to one embodiment of the present invention.

FIG. 3 illustrates a directive monopole antenna 300 according to another embodiment of the present invention, in which a ground plane 301 is provided. Ground plane 301 is disposed perpendicular to both support structure 302 and feed probe section 303. An opening 304 is provided in ground plane 301, for mounting support structure 302 and exciting the conductor (via feed probe section 303). Waveguide plug 305, which surrounds feed probe section 303, has an outside diameter and shape approximately equal to the inside diameter and shape of opening 304, to facilitate the easy mounting of support structure 302 onto ground plane 301, and to prevent feed probe section 303 of the conductor from coming into electrical contact with ground plane 301. In various embodiments of the present invention, opening 304 and waveguide plug 305 may be circular, polygonal, or even irregular, as may be required by the design constraints of directive monopole antenna 300.

While the foregoing exemplary embodiments have been described with reference to directive monopole antennas having four, five or six conductive directors, the scope of the present invention is not limited to such arrangements. Rather, as will be readily apparent to one of skill in the art, the present invention has application to directive monopole antennas with any number of directors greater than or equal to one.

Figure 4:
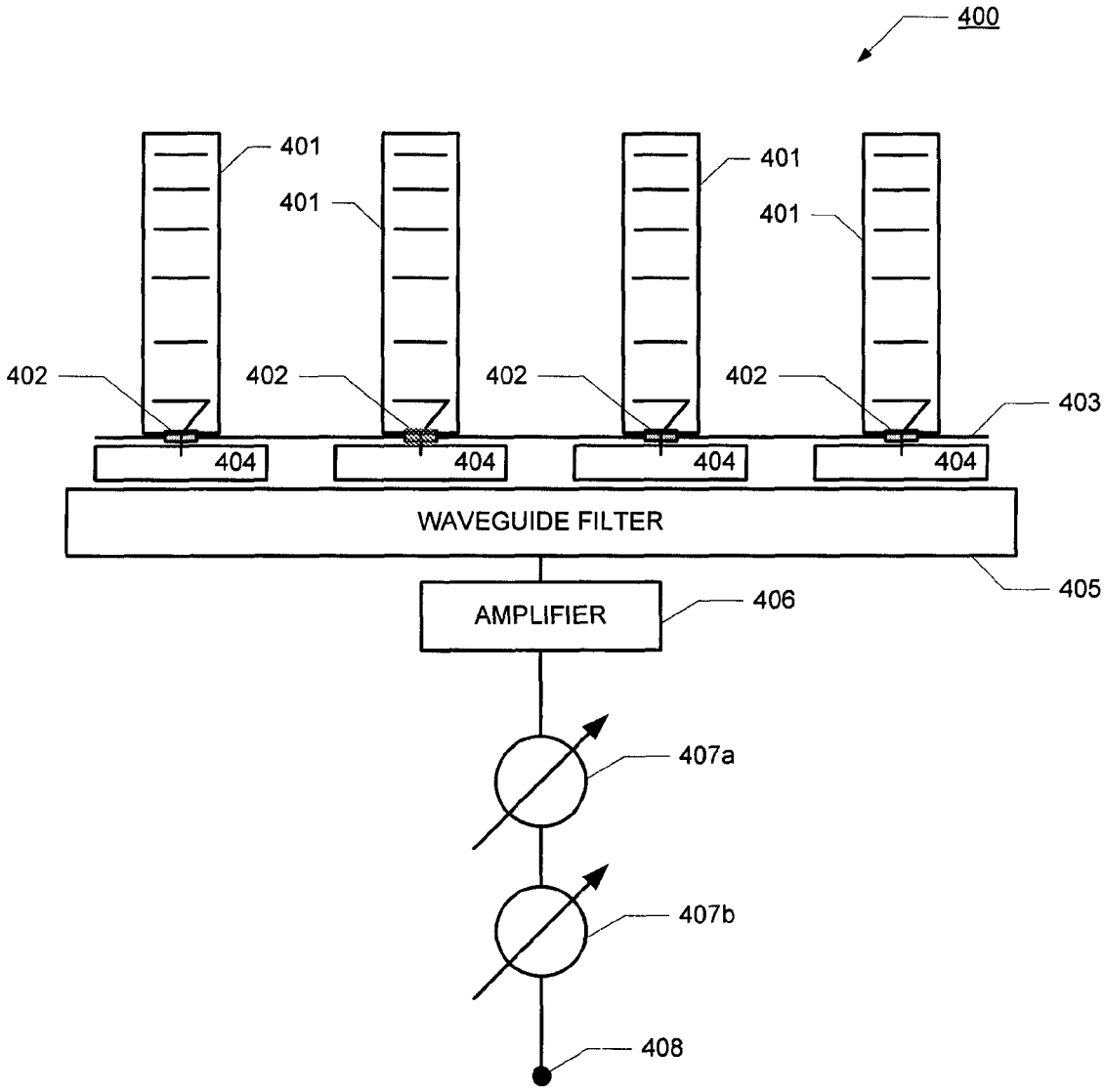
FIG. 4 illustrates a side view of an antenna array including a plurality of directive monopole antennas according to one embodiment of the present invention.

Turning to FIG. 4, an antenna array is illustrated according to one embodiment of the present invention. Antenna array 400 includes a plurality of bent directive monopole antenna elements 401 (similar to those described in greater detail above with respect to FIGS. 1A to 2) mounted in corresponding openings 402 of ground plane 403. According to one aspect of the present invention, the spacing between adjacent elements 401 is greater than about λ, where λ is an operating wavelength of antenna array 400. When the antenna array 400 of the present exemplary embodiment is operated in a transmit mode, a signal 408 passes through controllable phase shifter 407*a* and a controllable attenuator 407*b* to amplifier 406 (e.g., a solid state power amplifier "SSPA"), and from amplifier 406 to waveguide filter 405, which provides the signal in turn to each of the waveguides 404. In each waveguide 404, the signal excites a corresponding bent directive monopole antenna element 401. While the foregoing exemplary embodiment has been described with reference to a transmit mode of operation (e.g., in which amplifier 406 is a SSPA), it will be apparent to one of ordinary skill in the art that the antennas and antenna arrays of the various embodiments of the present invention may be configured to operate in a receive mode (e.g., in which amplifier 406 is a low noise amplifier "LNA").

While the exemplary embodiment illustrated in FIG. 4 has been illustrated with elements 401 arranged linearly, the scope of the present invention is not limited to such an arrangement. For example, in another embodiment, a 2×2 array of elements may be used. As will be apparent to one of skill in the art, the present invention has application to arrays of any number of antenna elements, disposed in any arrangement.

Figure 5:
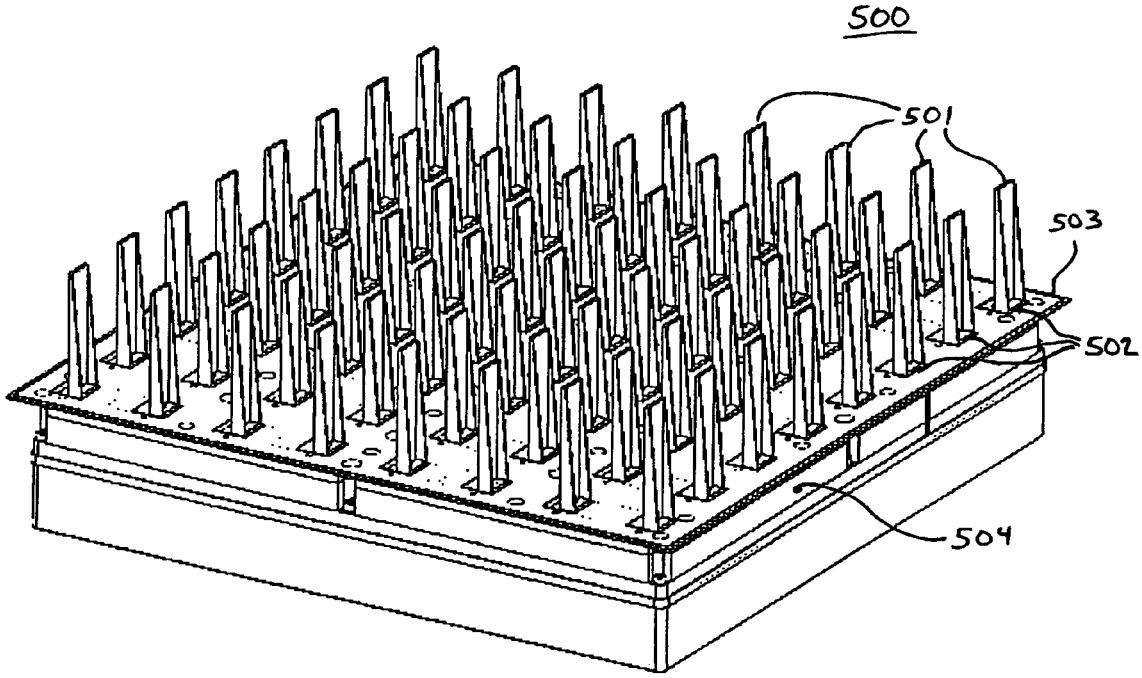
FIG. 5 illustrates an antenna array including a plurality of directive monopole antennas according to one embodiment of the present invention.

FIG. 5 illustrates an antenna array according to another embodiment of the present invention. Antenna array 500 includes a plurality of bent directive monopole antenna elements 501 mounted in corresponding openings 502 of ground plane 503. Antenna array 500 includes a waveguide assembly 504 for directing a signal to each element 501. Waveguide assembly 504 is illustrated in greater detail with respect to FIGS. 6A to 6C, below.

Figure 6A:
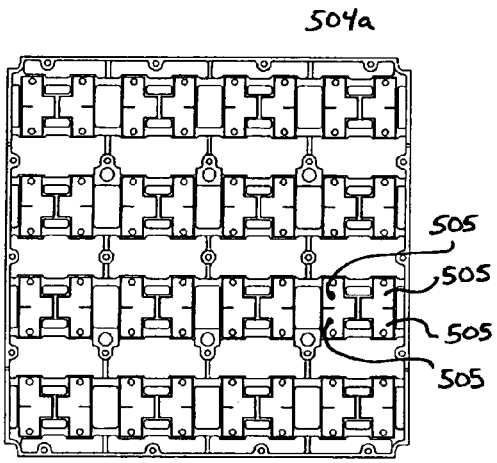
FIGS. 6A to 6C illustrate waveguide assemblies for an antenna array according to one embodiment of the present invention.
Figure 6B:
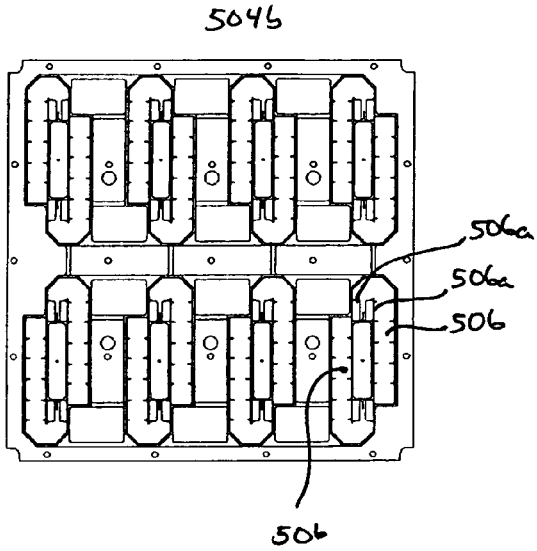
Figure 6C:
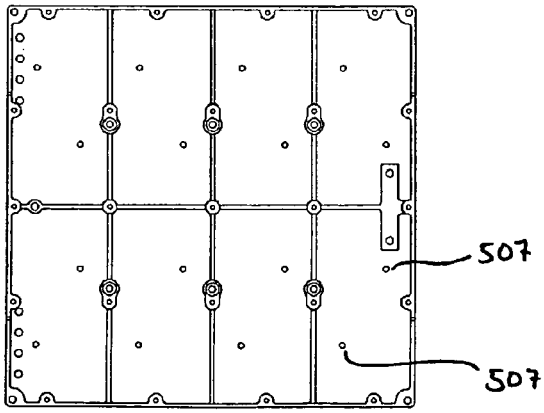

According to the present exemplary embodiment, waveguide assembly 504 includes three stacked plates 504*a*, 504*b* and 504*c*, illustrated in FIGS. 6A, 6B and 6C, respectively. Plate 504*a* illustrated in FIG. 6A includes waveguides 505, each of which feeds a single antenna element 501. Waveguides 505 are arranged in pairs, such that when plate 504*a* is stacked upon plate 504*b* (illustrated in FIG. 6B), each pair of waveguides 505 is fed through one of two ports 506*a* at the end of a single waveguide filter 506. When plate 504*b* is stacked upon plate 504*c* (illustrated in FIG. 6C), each waveguide filter 506 is fed a signal from amplifier port 507. In this manner, a signal from an amplifier passes through amplifier port 507, through waveguide filter 506, through two ports 506*a* to four waveguides 505, each of which corresponds to a single antenna element 501.

Figure 7:
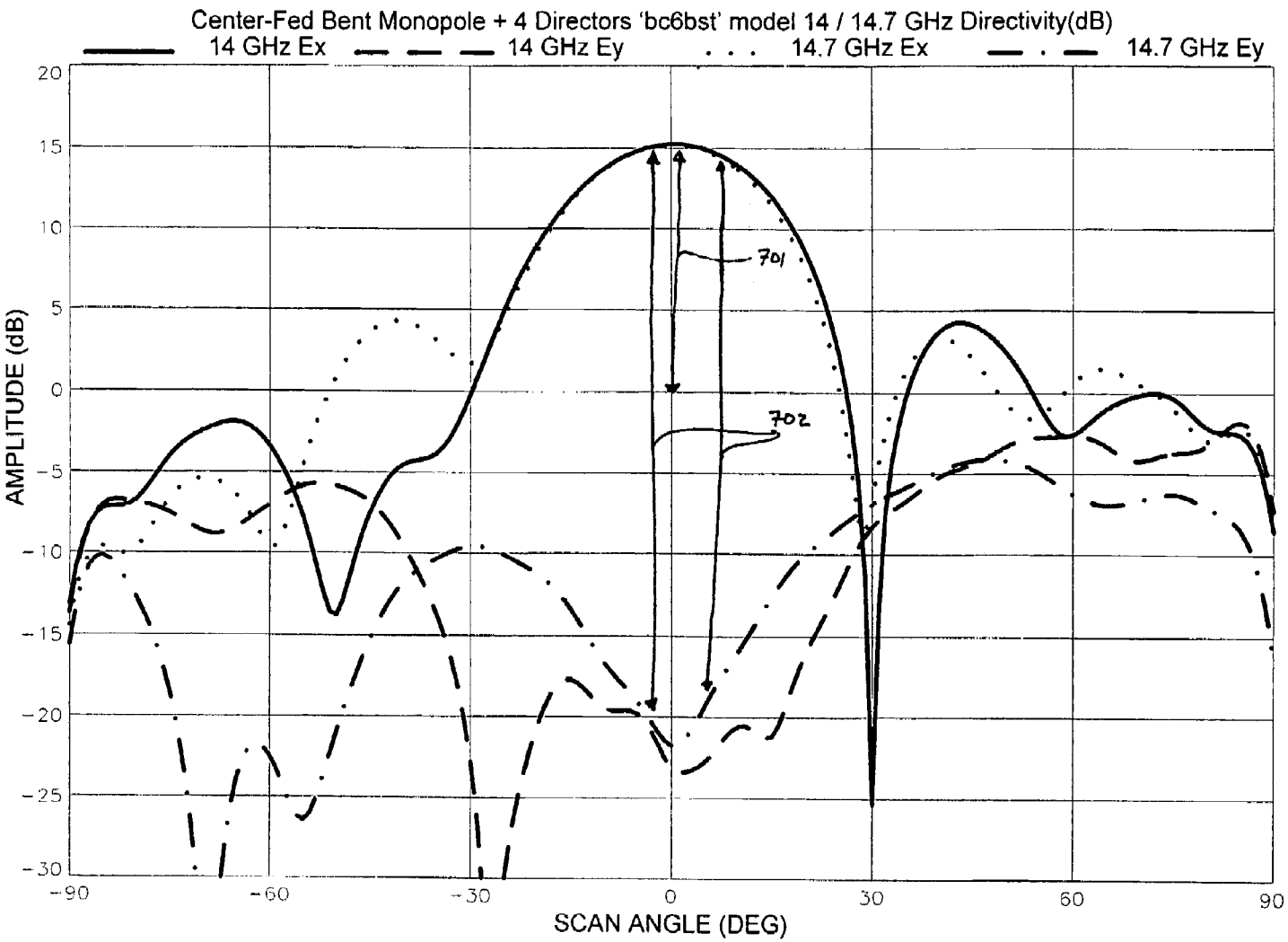
FIGS. 7 to 9 are graphs illustrating various advantages in performance of directive monopole antennas according to various aspects of the present invention.

FIG. 7 is a graph illustrating theoretically predicted (e.g., using WIPL-D and NEC) advantages of a directive monopole antenna in directivity and both co-polar and cross-polar isolation according to one embodiment of the present invention. As can be seen with reference to FIG. 7, a directivity of 15.1 dB (reference no. 701) can be achieved over a receive band of 14.0 GHz to 14.7 GHz, while enjoying better than −30 dB of cross-polarization (reference no. 702) relative to peak co-polar over a range of scan angles from about −10° to about 10° (e.g., inside the scan angle of the Earth disk from geostationary orbit).

Figure 8:
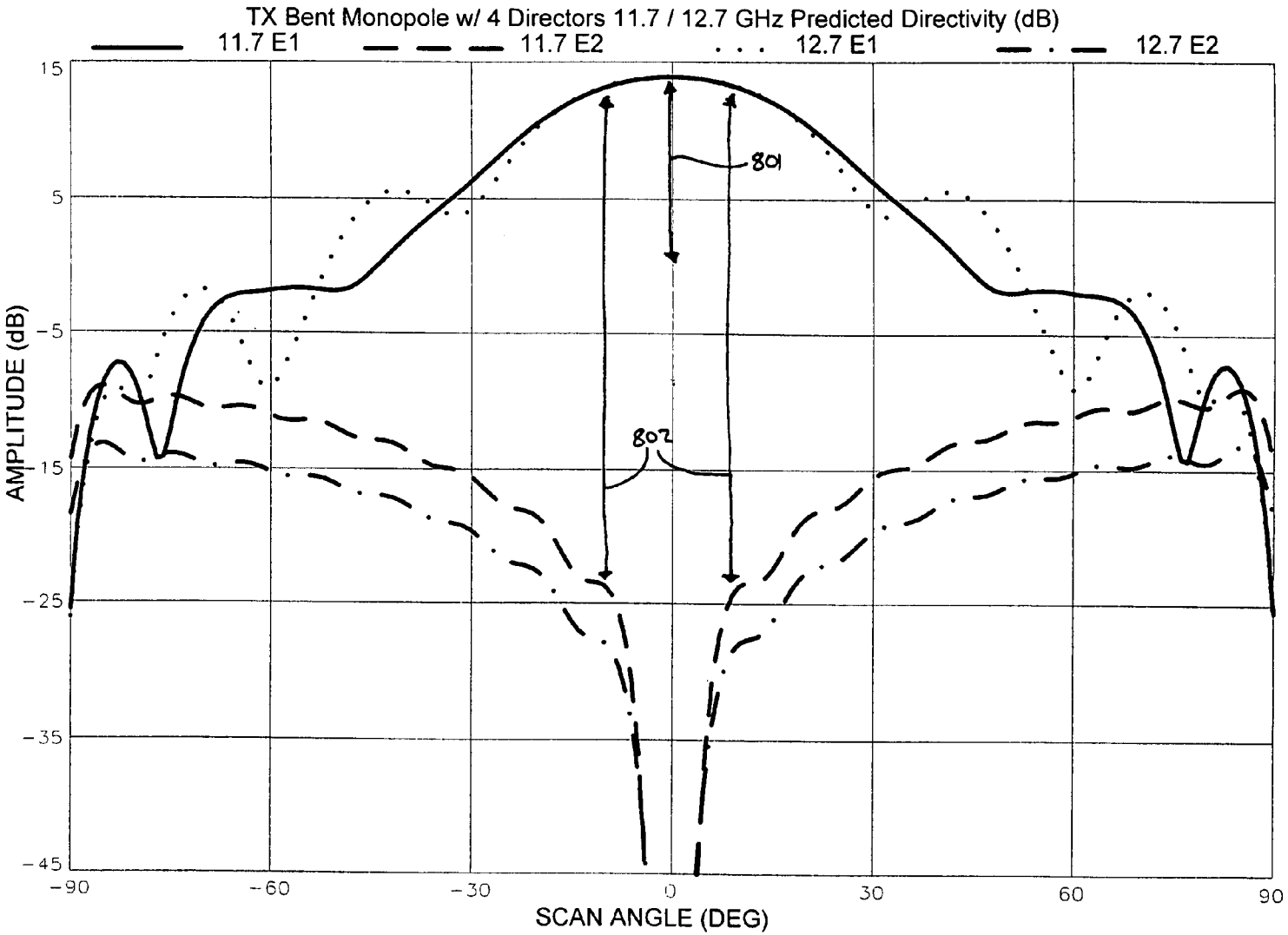

FIG. 8 is a graph illustrating theoretically predicted (e.g., using WIPL-D and NEC) advantages of a directive monopole antenna in directivity and both co-polar and cross-polar isolation according to one embodiment of the present invention. As can be seen with reference to FIG. 8, a directivity of 15.1 dB (reference no. 801) can be achieved over a transmit band of 11.7 GHz to 12.7 GHz, while enjoying better than −30 dB of cross-polarization (reference no. 802) relative to peak co-polar over a range of scan angles from about −10° to about 10° (e.g., inside the scan angle of the Earth disk from geostationary orbit).

Figure 9:
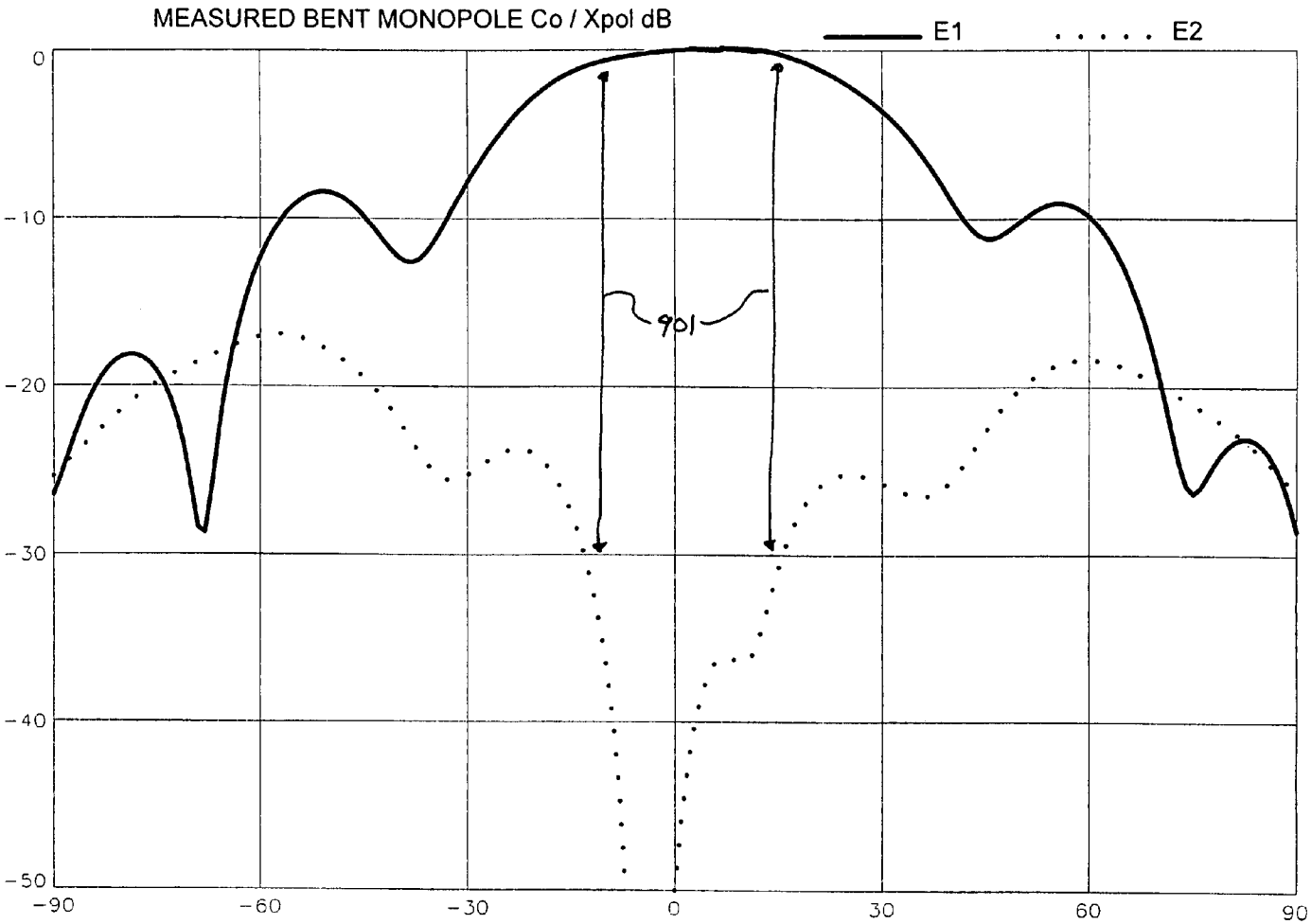

FIG. 9 is a graph illustrating experimentally confirmed advantages of a directive monopole antenna in directivity and both co-polar and cross-polar antenna patterns according to one embodiment of the present invention. As can be seen with reference to FIG. 9, the computer optimized directive monopole antenna 200 of FIG. 2 enjoys better than −30 dB of cross-polarization (reference no. 901) relative to peak co-polar over a range of scan angles from about −10° to about 10° (e.g., inside the scan angle of the Earth disk from geostationary orbit).

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. A directive monopole antenna comprising:

a dielectric support structure;

a conductor coupled to an end of the support structure, the conductor having a feed probe section disposed in a first plane of the support structure and extending beyond the end of the support structure, the conductor further having a bent section disposed in the first plane perpendicular to the feed probe section, the feed probe section and the bent section being electrically coupled by an intermediate section disposed at an acute angle to the bent section; and one or more conductive directors coupled to the support structure, each of the one or more conductive directors being disposed in the first plane of the support structure and parallel to the bent section of the conductor.

2. The directive monopole antenna of claim 1, wherein the feed probe section is disposed in a middle of the end.

3. The directive monopole antenna of claim 1, wherein the one or more conductive directors are offset closer to one side of the support structure, and the feed probe section is electrically centered in the end.

4. The directive monopole antenna of claim 1, further comprising a ground plane having an opening, the ground plane being disposed perpendicular to the first plane and perpendicular to the feed probe section, the feed probe section being disposed in the opening of the ground plane.

5. The directive monopole antenna of claim 4, further comprising a dielectric plug disposed around the feed probe section and in the opening.

6. The directive monopole antenna of claim 1, wherein the conductor and the one or more directors are composed of copper.

7. The directive monopole antenna of claim 1, wherein the bent section and each of the one or more directors has a length approximately equal to λ/2, where λ is an operating wavelength of the directive monopole antenna.

8. The directive monopole antenna of claim 7, wherein the length of the bent section and the length of each of the one or more directors are selected by computer optimization.

9. The directive monopole antenna of claim 1, wherein a spacing between the bent section and the one or more directors is selected by computer optimization.

10. The directive monopole antenna of claim 1, wherein the one or more directors comprise three or more directors, and the three or more directors are unevenly spaced.

11. The directive monopole antenna of claim 10, wherein a spacing between each of the three or more directors is selected by computer optimization.

12. The directive monopole antenna of claim 1, wherein the directive monopole antenna is fed by a waveguide.

13. The directive monopole antenna of claim 1, wherein the directive monopole antenna is fed by one of: a coaxial line, a stripline or a microstrip line.

14. The directive monopole antenna of claim 1, wherein the directive monopole antenna has a directivity greater than about 15 dB.

15. The directive monopole antenna of claim 1, wherein the directive monopole antenna has a cross-polarization of better than about −35 dB.

16. An antenna array comprising:

a plurality of bent directive monopole antenna elements, each of the bent directive monopole antenna elements including:

a dielectric support structure, a conductor coupled to an end of the support structure, the conductor having a feed probe section disposed in a first plane of the support structure and extending beyond the end of the support structure, the conductor further having a bent section disposed in the first plane perpendicular to the feed probe section, the feed probe section and the bent section being electrically coupled, and one or more conductive directors coupled to the support structure, each of the one or more conductive directors being disposed in the first plane of the support structure and parallel to the bent section of the conductor; and a ground plane with a plurality of openings corresponding to the plurality of bent directive monopole antenna elements, each of the plurality of bent directive monopole antenna elements being disposed in one of the plurality of openings in the ground plane;

a plurality of waveguides corresponding to the plurality of bent directive monopole antenna elements, each of the plurality of bent directive monopole antenna elements being fed by a corresponding waveguide; and one or more amplifiers operatively coupled to the plurality of bent directive monopole antenna elements.

17. The antenna array of claim 16, wherein the plurality of waveguides a waveguide filter.

18. The antenna array of claim 16, further comprising a controllable phase shifter configured to provide a signal to the amplifier.

19. The antenna array of claim 16, further comprising a controllable attenuator configured to provide a signal to the amplifier.

20. The antenna array of claim 16, wherein the plurality of bent directive monopole antenna elements are center-fed elements.

21. The antenna array of claim 16, wherein a spacing between adjacent ones of the plurality of bent directive monopole antenna elements is greater than $\lambda$, where $\lambda$ is an operating wavelength of the antenna array.

22. A directive monopole antenna comprising:

a dielectric support structure;

a conductor coupled to an end of the support structure, the conductor having a feed probe section disposed in a first plane of the support structure and extending beyond the end of the support structure, the feed probe section being electrically centered in the end, the conductor further having a bent section disposed in the first plane perpendicular to the feed probe section, the feed probe section and the bent section being electrically coupled; and one or more conductive directors coupled to the support structure, each of the one or more conductive directors being disposed in the first plane of the support structure and parallel to the bent section of the conductor, the one or more conductive directors being offset closer to one side of the support structure.

* * * * *

UNITED STATES PATENT AND TRADEMARK OFFICE

CERTIFICATE OF CORRECTION

PATENT NO. : 7,352,336 B1
APPLICATION NO. : 11/652608
DATED : April 1, 2008
INVENTOR(S) : Lier et al.

It is certified that error appears in the above-identified patent and that said Letters Patent is hereby corrected as shown below:

IN THE CLAIMS

In claim 17, column 8, line 9, "waveguides a waveguide filter." should read --waveguides comprises a waveguide filter.--

Signed and Sealed this

Twentieth Day of October, 2009

David J. Kappos

David J. Kappos
*Director of the United States Patent and Trademark Office*